US006139071A

United States Patent [19]

Hopper

[11] Patent Number: 6,139,071

[45] Date of Patent: Oct. 31, 2000

[54] LOCKING SYSTEM FOR A DOUBLE-HUNG WINDOW

[76] Inventor: James P. Hopper, 249 Mt. Vernon Ave., Export, Pa. 15632

[21] Appl. No.: 09/026,268

[22] Filed: Feb. 19, 1998

Related U.S. Application Data

[60] Provisional application No. 60/035,407, Feb. 19, 1997.

[51] Int. Cl.[7] ..... E05C 1/06

[52] U.S. Cl. ..... 292/158; 292/36; 292/DIG. 20; 292/DIG. 47; 292/162

[58] Field of Search ..... 49/395; 292/32–40, 292/42, 137, 156, 161, 162, 145, DIG. 20, DIG. 47, 158, 41

[56] References Cited

U.S. PATENT DOCUMENTS

| | | | |
|---|---|---|---|
| 783,013 | 2/1905 | Bolton | 292/37 |
| 784,446 | 3/1905 | Taylor et al. | 292/37 |
| 925,414 | 6/1909 | Agin | 292/37 |
| 1,704,601 | 3/1929 | Hall . | |
| 2,317,312 | 4/1943 | Swanson et al. . | |
| 4,253,688 | 3/1981 | Hosooka . | |
| 4,482,178 | 11/1984 | Damiana | 292/42 |
| 4,578,903 | 4/1986 | Simpson | 49/180 |
| 5,090,750 | 2/1992 | Lindqvist | 292/7 |
| 5,127,685 | 7/1992 | Dallaire et al. | 292/42 |
| 5,139,291 | 8/1992 | Schultz | 292/42 |
| 5,165,737 | 11/1992 | Riegelman | 292/42 |
| 5,244,238 | 9/1993 | Lindqvist | 292/7 |
| 5,570,548 | 11/1996 | Hopper . | |
| 5,671,958 | 9/1997 | Szapucki et al. | 292/DIG. 47 |
| 5,791,700 | 8/1998 | Biro | 292/7 |

*Primary Examiner*—B. Dayoan
*Assistant Examiner*—John B. Walsh
*Attorney, Agent, or Firm*—Webb Ziesenheim Logsdon Orkin & Hanson, P.C.

[57] ABSTRACT

A double-hung window construction includes a window jamb and a pair of sashes slidably movable within the window jamb. A pivot member pivotally connects each sash to the window jamb such that the sash can tilt relative to the window jamb around the pivot member. A combined locking and tilting mechanism is attached to each sash. The mechanism is movable between a locked position preventing sliding or tilting of the window, an operative position permitting sliding of the sash and preventing tilting of the sash, and a tilting position which allows the tilting movement of the sash. Each locking and tilting mechanism is independent of the operation of the remaining locking and tilting mechanism.

20 Claims, 8 Drawing Sheets

LOCKING SYSTEM FOR A DOUBLE-HUNG WINDOW

This application claims the benefit of co-pending U.S. Provisional Patent Application Ser. No. 60/035,407 entitled "Locking System For a Double-Hung Window", filed Feb. 19, 1997.

BACKGROUND OF THE INVENTION

1. Field of the Invention

The present invention relates to a window locking mechanism. More specifically, the present invention relates to windows having combined locking and tilting mechanisms.

2. Prior Art

Current double-hung window constructions provide a window jamb with a pair of slidable sashes therein. The window construction generally includes a locking mechanism provided on the meeting rails of both sashes for securing the sashes together and for securing the window in a closed position. An improvement over this typical construction is found in the double-hung window manufactured by Caradon Thermal-Gard Division which includes independent locks for the upper and lower sashes. Known designs additionally incorporate a separate tilting mechanism for each sash allowing the sash to tilt relative to the window jamb generally for cleaning purposes. The existing Caradon Thermal-Gard Division window design also incorporates separate tilting release mechanisms on the top of each sash.

The existing tilting mechanisms suffer from a variety of drawbacks. The known tilting mechanisms are often provided on opposite sides of the sash. Providing a tilting mechanism on opposite sides of the top sash rail of the sash makes the mechanism inaccessible for some users, particularly in wide window units. In wide window units, it is not easy for the user to reach the opposed ends of the top sash rail. The design of existing tilt mechanisms limits the user's hand positions during tilting of the windows. In general, the user must maintain his or her hands on the opposed ends of the top sash rail. Aside from accessability, this hand position may not be the most comfortable or effective for the user, particularly in wide, heavy window designs. Additionally, the separate tilting mechanisms and locking mechanisms of the prior art require a lot of separate components to be incorporated into the sash during manufacturing, significantly increasing the manufacturing time.

It is an object of the present invention to overcome the aforementioned drawbacks of the prior art. It is a further object of the present invention to provide a combined locking and tilt mechanism for the sashes of double-hung windows and the like. It is a further object of the present invention to provide independent locking and operation of the sashes of double-hung windows and the like. It is another object of the present invention to provide a window construction with a locking and tilting mechanism construction which is easy to use and simple and economical to manufacture.

SUMMARY OF THE INVENTION

The objects of the invention are achieved by providing a window according to the present invention. The window includes a window jamb with at least one sash slidably movable in the window jamb. The sash will include a pivot member pivotally connecting the sash to the window jamb such that the sash can tilt relative to the window jamb around the pivot member. A single locking unit is attached in each sash. The locking unit is movable between a first position locking the sash relative to the window jamb preventing both the sliding and tilting movement of the sash, a second position allowing the sliding movement and preventing the tilting movement of the sash, and a third position allowing the tilting movement of the sash. The invention provides a combined locking and tilting mechanism for each sash which will operate independent of other sashes in the window. This construction will provide a number of advantages which will be described in greater detail below.

In a double-hung window construction of the present invention, two sashes will be provided with each sash having a single locking unit operating independent of the other as discussed above.

The locking unit of the present invention includes a housing, a main slide, a locking rod and a keeper member. The housing is adapted to be attached to the sash of the window with the main slide slidably positioned within the housing. The locking rod is attached to and extends from an end of the main slide, and the keeper member is mounted on the jamb of the window. The main slide is movable between a first position where the locking rod is engageable with the keeper member, a second position wherein the locking rod is spaced from the keeper member along the longitudinal axis of the locking rod, and a third position wherein the locking rod is spaced farther from the keeper member than in the second position.

One embodiment of the present invention provides that the housing includes a slot on a front face thereof with the main slide including a slide handle extending through the slot. A movable stop may be provided on the main slide which is engageable with the housing to prevent movement of the main slide to the third tilting position when the stop is in the locked position. The housing slot may be provided with an undercut portion wherein the stop, when in the locked position, is engageable with the housing in the undercut such that a portion of the housing overlaps the stop.

The present invention may provide a plurality of indicating indicia on the main slide which is selectively visible through the slot to be indicative of the relative position of the main slide. The present invention may include a second slide slidably positioned relative to the housing with a second locking rod attached to and extending from the second slide and a second keeper member mounted on the jamb of the window with a pivot member pivotally attached to the housing coupling the main slide to the second slide.

These and other advantages of the present invention will be clarified in the description of the preferred embodiment taken together with the attached figures, wherein like reference numerals represent like elements throughout.

BRIEF DESCRIPTION OF THE PREFERRED EMBODIMENT

Figure 1:
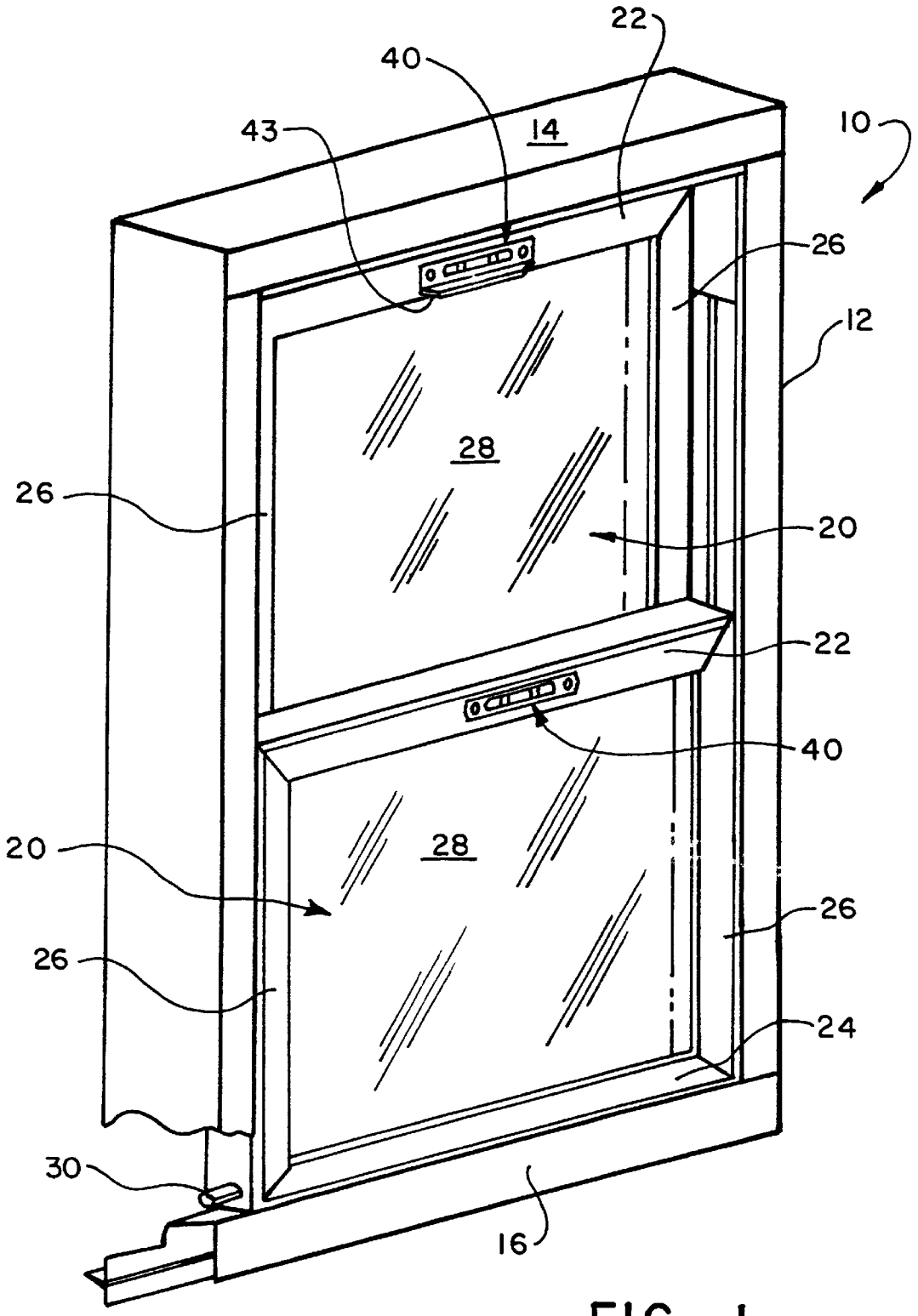
FIG. 1 is a perspective view, partially broken away, of a window according to the present invention.

FIG. 1 illustrates a double-hung window 10 according to the present invention. The window 10 includes a window jamb 12 of substantially conventional construction. The window jamb 12 is essentially the same as currently manufactured by Caradon Thermal-Gard Division. The window jamb 12 includes a header 14 in a sill 16 having a stepped configuration.

A pair of sashes 20 is slidably mounted in the window jamb 12. Each sash 20 includes a top rail 22, a bottom rail 24 and a pair of side rails 26 surrounding a glazing panel 28. The glazing panel 28 may be a single, double or triple pane unit as is known in the art. The specific construction of the sashes 20, without additional window hardware, is described in detail in my prior U.S. Pat. Nos. 5,379,518 and 5,570,548 which are incorporated herein by reference. Other known sash arrangements may also be utilized with the window 10 of the present invention.

A pivot member 30 extends from the bottom rail 24 of each sash 20 to pivotally connect the sash 20 to the side of the window jamb 12. Each sash 20 can tilt relative to the window jamb 12 about the pivot member 30 as will be described in detail hereinafter. The pivot member 30 is rotatably received in a slidable carriage (not shown) for movement in a channel 32 (shown in FIGS. 2A, 3A and 4A) formed in the sash 20 in a manner known in the art.

Each sash 20 includes a tilting and locking mechanism formed by a single locking unit 40 attached to the top rail 22 of each sash 20.

The combination tilting and locking mechanism formed by locking unit 40 is movable between a locked position, an operative position and a tilting position. The locked position shown in FIGS. 2A and 2B will lock the respective sash 20 relative to the window jamb 12 preventing sliding, tilting movement of the sash 20 relative to the window jamb 12. The locking unit 40 is freely movable from the locked position to the operative position illustrated in FIGS. 3A and 3B. With the locking unit 40 in the operative position, the sash 20 is able to slide relative to the window jamb 12 and is prevented from tilting relative to the window jamb 12. The locking unit 40 is movable from the operative position to the tilting position illustrated in FIGS. 4A and 4B. With the locking unit 40 in the tilting position, the sash 20 is allowed to tilt relative to the window jamb 12. The operation of the window 10 will be further clarified after a complete description of the individual components of the locking unit 40.

The locking unit 40 includes a housing 42 attached to the top rail 22 of each sash 20. The housing 42 is shown in detail in FIGS. 5A–5D. The housing 42 includes a front face 44 having a pair of screw holes 46 for attachment of the housing 42 to the top rail 22 of the sash 20. A lift or handle 43, shown in the housing 42 of the locking unit 40 of the upper sash 20 in FIG. 1, may extend forwardly from a lower edge of the housing 42. A central elongated slot 48 extends through the front face 44. A pair of spaced flanges 50 extends rearwardly from the front face 44 forming a housing channel 52 therebetween. The flanges 50 are on opposite sides of the slot 48. Each flange 50 includes a pivot pin hole 54 extending therethrough and a semicircular saddle 56 partially surrounding the pivot pin hole 54. Each saddle 56 extends into the housing channel 52. Each flange 50 includes a pair of elongated projections 58 extending into the housing channel 52 at an end of each flange 50 spaced from the front face 44. The housing 42 includes an undercut portion 60 adjacent one end of the slot 48 which will form a stepped configuration in cross section as shown in FIG. 3B.

Figure 6A:
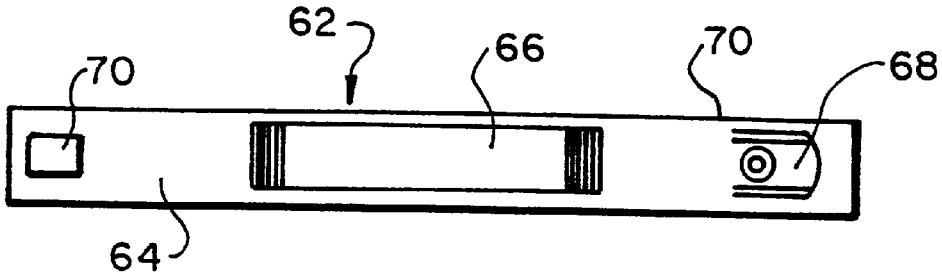
FIG. 6A is a front view of a main slide of the window locking unit illustrated in FIG. 2A.
Figure 6B:
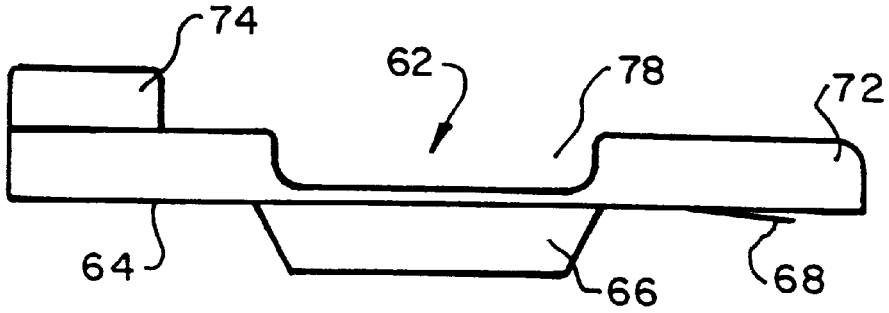
FIG. 6B is a top view of the main slide illustrated in FIG. 6A.
Figure 6C:
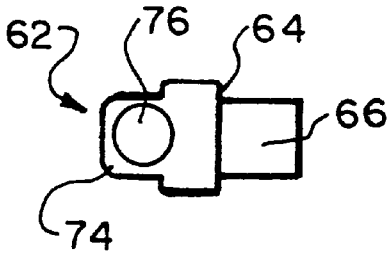
FIG. 6C is a side end view of the main slide illustrated in FIG. 6A.
Figure 6D:
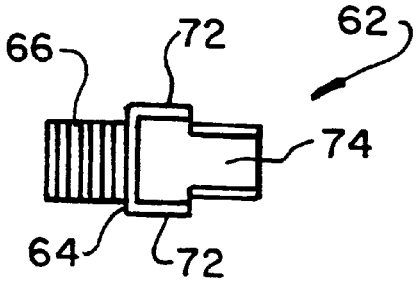
FIG. 6D is a right side end view of the main slide illustrated in FIG. 6A.

The locking unit 40 includes a main slide 62 slidably positioned within the housing channel 52 of the housing 42. The main slide 62 is illustrated in greater detail in FIGS. 6A–6E. The main slide 62 includes a front face 64 with a slide handle 66 extending forwardly from a central portion of the front face 64. The slide handle 66 extends through the slot 48 of the housing 42. The front face 64 includes a movable stop 68 extending forwardly of the front face 64 as best shown in FIG. 6B. The movable stop 68 may easily be formed as a portion of the front face 64 which is cut out on three sides to be movable relative to the front face 64. The thickness of the movable stop 68 may be formed generally thicker than the remaining portions of the front face 64 to ensure that the movable stop 68 extends forwardly of the front face 64, as shown in FIG. 6B, in the unbiased position.

The main slide 62 includes a plurality of indicating indicia 70 which are selectively visible through the slots 48 of the housing 42 to be indicative of the relative position of the main slide 62 and the locking unit 40. The indicating indicia 70 may be color coded, such as a red rectangle shown on the left-hand portion of the front face 64 and a green circle on the movable stop 68. The indicating indicia 70 may take many forms which are selectively visible to be indicative of the relative positions of the main slide 62 and the locking unit 40.

Figure 6E:
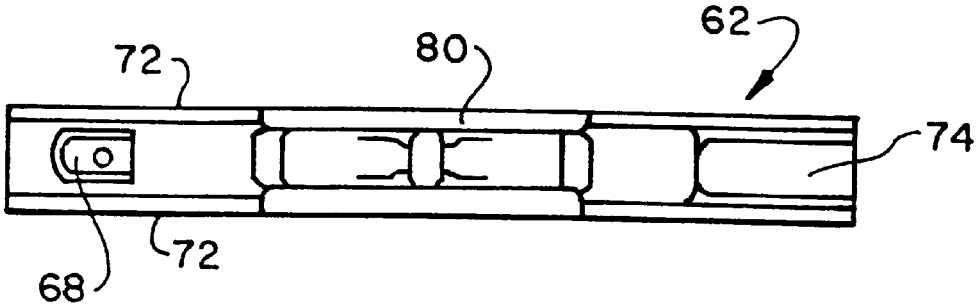
FIG. 6E is a rear view of the main slide illustrated in FIG. 6A.

The main slide 62 includes a set of spaced rails 72 extending rearwardly from one side of the front face 64 which includes the movable stop 68. A block member 74 extends rearwardly from the front face 64 on a side of the main slide 62 opposite the rails 72. As shown in FIG. 6E, the block member 74 has a width generally equal to the spacing of the inner surface of the rails 72. A cylindrical rod mounting hole 76 extends into the block member 74 from the end of the main slide 62. As shown in FIG. 6B, the block member 74 extends farther from the front face 64 than the rails 72. Additionally, as shown in FIG. 6B, a pivot pin recess 78 is spaced between the block member 74 and the rails 72. As shown in FIG. 6E, a pivot head receiving saddle 80 is formed on the back surface of the front face 64 generally within the back of the slide handle 66.

Figure 7A:
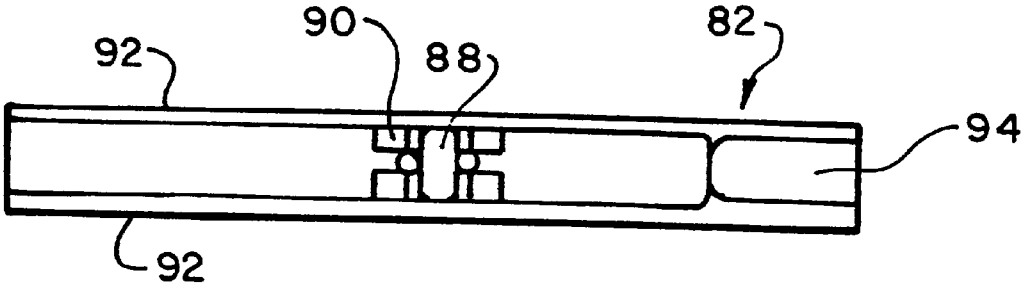
FIG. 7A is a front view of a second slide of the window locking unit illustrated in FIG. 2A.
Figure 7B:
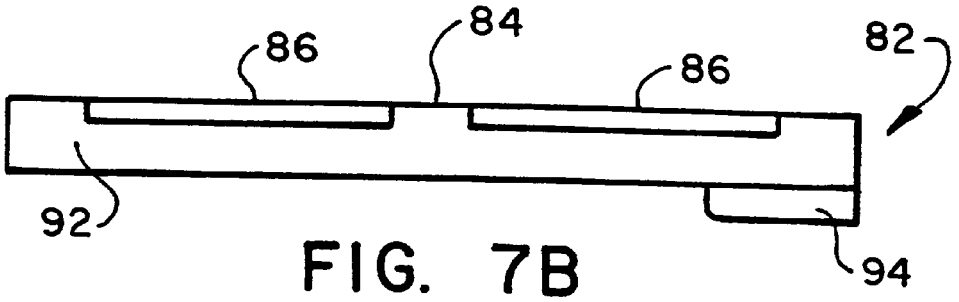
FIG. 7B is a top view of the second slide illustrated in FIG. 7A.
Figure 7C:
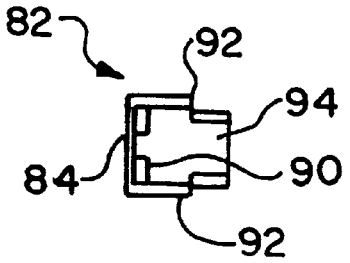
FIG. 7C is a left side end view of the second slide illustrated in FIG. 7A.
Figure 7D:
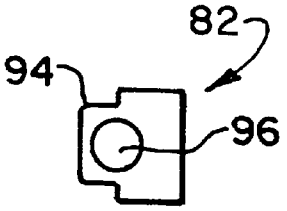
FIG. 7D is a right side end view of the second slide illustrated in FIG. 7A.
Figure 7E:
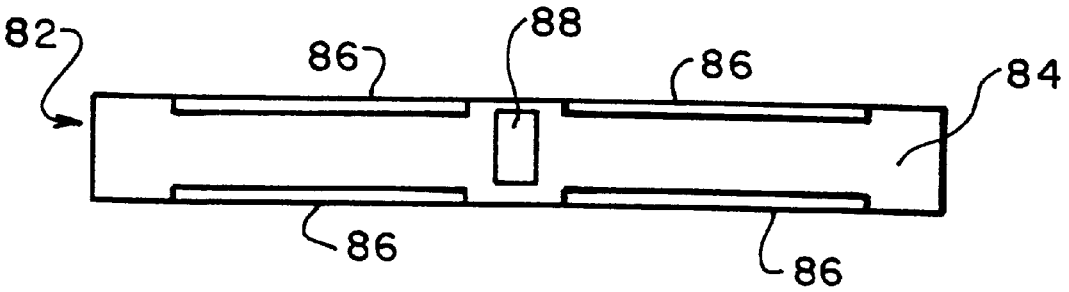
FIG. 7E is a rear view of the second slide illustrated in FIG. 7A.

The locking unit 40 includes a second slide 82 slidably positioned within the housing channel 52 of the housing 42. The second slide 82 is shown in detail in FIGS. 7A–7E. The second slide 82 includes a rear face 84 shown in FIG. 7E. A plurality of substantially rectangular, elongated recesses 86 is provided along the side edges of the rear face 84. The recesses 86 are adapted to slidably receive the projections 58 of the housing 42 therein. The engagement of the projections 58 within the recesses 86 maintains the main slide 62 and the second slide 82 within the housing channel 52. The receipt of the projections 58 within the recesses 86 also limits the extent of the sliding motion of each slide 62 and 82 within the housing channel 52 as will be described hereinafter. The rear face 84 includes a pivot head hole 88 extending therethrough which is formed in the center of a pivot head receiving saddle 90 formed on the front portion of the rear face 84 as shown in FIG. 7A.

The second slide 82 includes a pair of spaced rails 92 extending forwardly from the rear face 84. The second slide 82 additionally includes block member 94 extending forwardly from the rear face 84 at one end of the second slide 82. The block member 94 includes a cylindrical rod mounting hole 96 extending into the block member 94 from an end of the second slide 82. The width of the block member 94 is generally equal to the spacing of the inner surface of rails 92 as shown in FIG. 7A.

The second slide 82 is slidably mounted within the housing channel 52 on the main slide 62. The block member 94 of the second slide 82 is received between the spaced rails 72 of the main slide 62. Similarly, the block member 74 of the main slide 62 is received between the spaced rails 92 of the second slide 82. These interlocking members provide an aligned sliding engagement for the second slide 82 and main slide 62. Additionally, the rod mounting holes 96 and 76 are substantially aligned with each other.

Figure 8A:
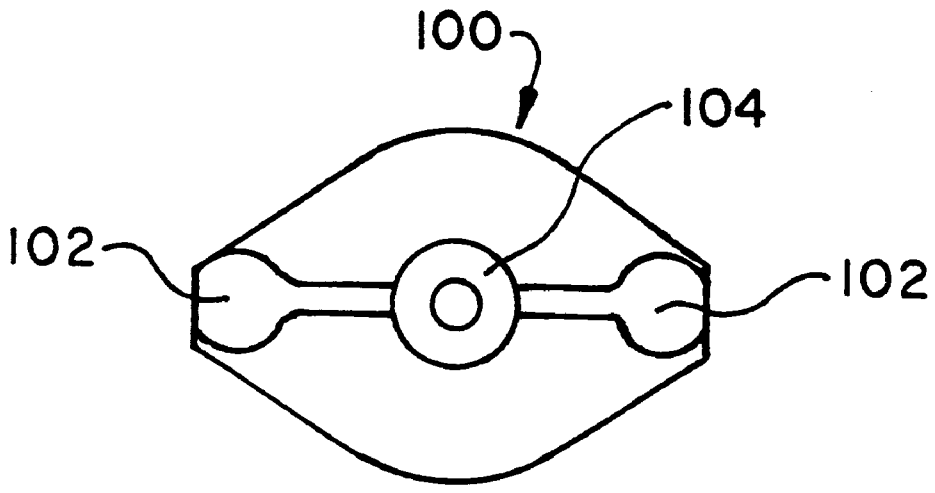
FIG. 8A is a plan view of a pivot member of the window locking unit illustrated in FIG. 2A.
Figure 8B:
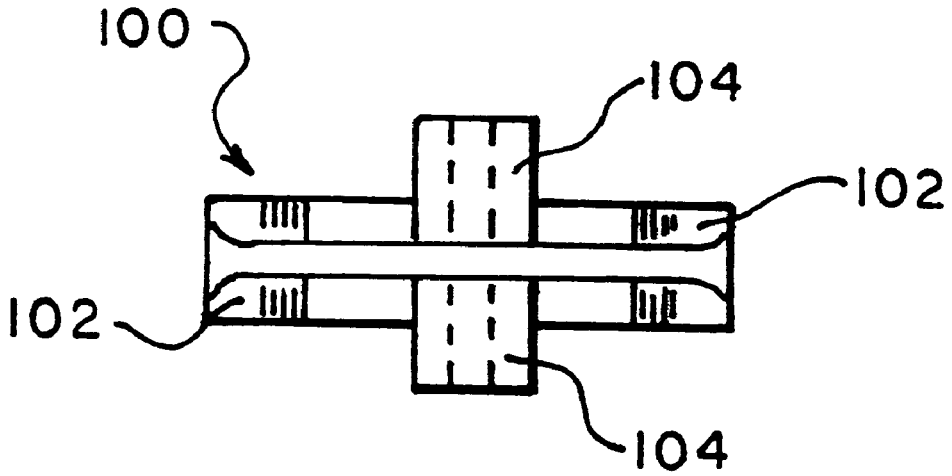
FIG. 8B is an end view of the pivot member illustrated in FIG. 8A.

Each locking unit 40 includes a pivot member 100 which is pivotally attached to the housing 42 to couple the main slide 62 to the second slide 82. The pivot member 100 is illustrated in greater detail in FIGS. 8A and 8B. The pivot member 100 includes an enlarged pivot head 102 at opposed ends thereof. A central pivot pin 104 extends outwardly of the body of the pivot member 100 as shown in FIG. 8B. Each pivot head 102 is received in one respective pivot head receiving saddle 80 or 90 of the main slide 62 or second slide 82. The pivot head 102, which is received in the pivot head receiving saddle 90, will extend through the pivot head hole 88. The pivot pin 104 extends through each pivot pin recess 78 of the main slide 62 through the pivot pin hole 54 in each flange 50 of the housing 42. The pivot pin saddles 56 of the housing 42 also maintain the pivot pins 104 in this appropriate pivoting location. In operation, sliding of the main slide 62 will cause pivoting of the pivot member 100 about pivot pin 104 through pivot head receiving saddle 80. The pivoting movement of the pivot member 100 will cause a corresponding sliding movement of the second slide 82 through pivot head receiving saddle 90. This construction couples the movement of the main slide 62 to the second slide 82 such that sliding movement of the main slide 62 results in a corresponding opposite sliding motion of the second slide 82.

Figure 2A:
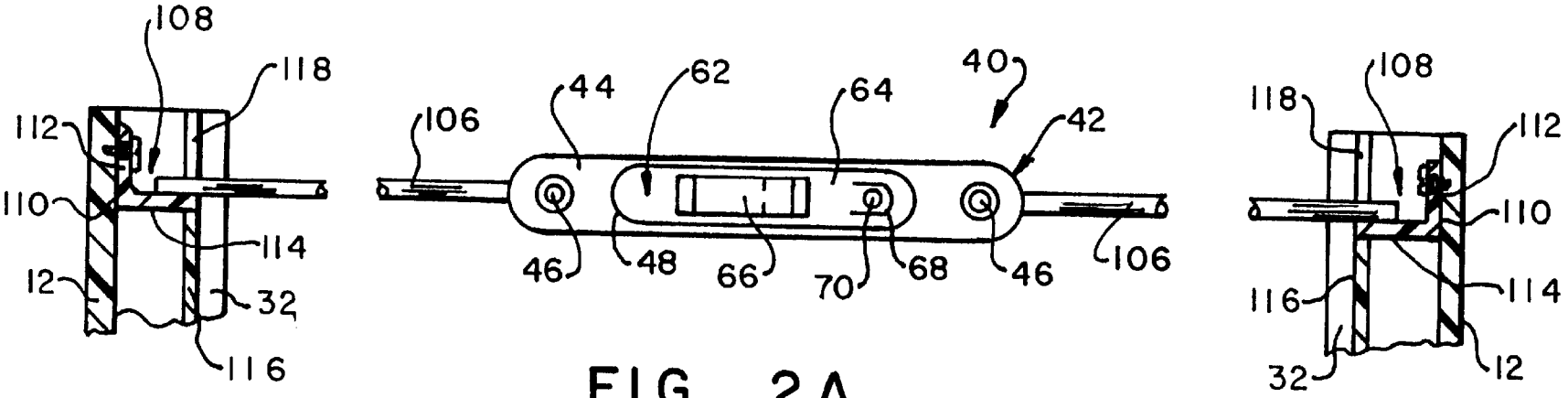
FIG. 2A is a front view of relevant portions of a window locking unit of the window illustrated in FIG. 1 with the window locking unit in a locked position.
Figure 3A:
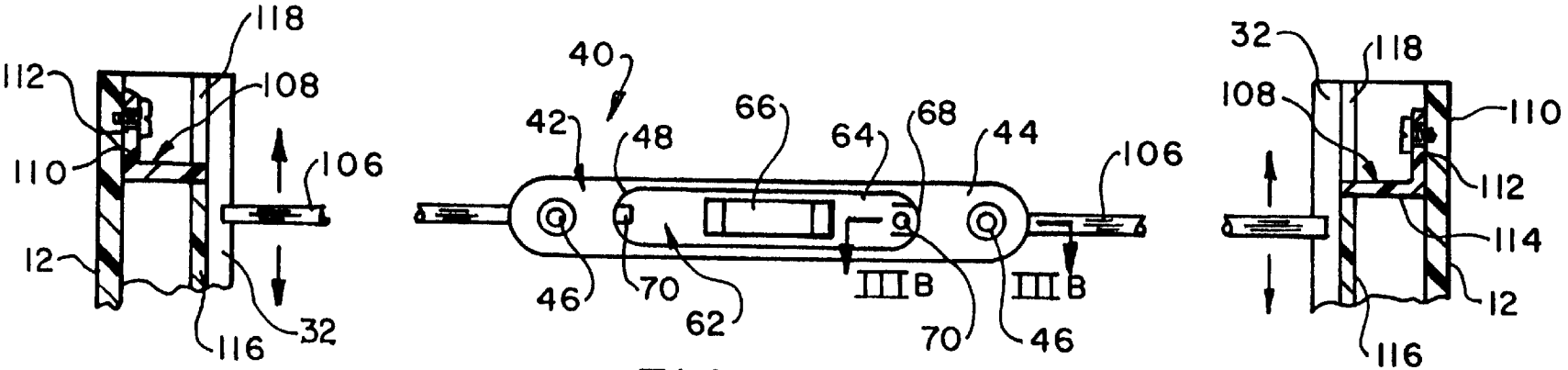
FIG. 3A is a front view of the window locking unit shown in FIG. 2A with the window locking unit in an operative position.
Figure 3B:
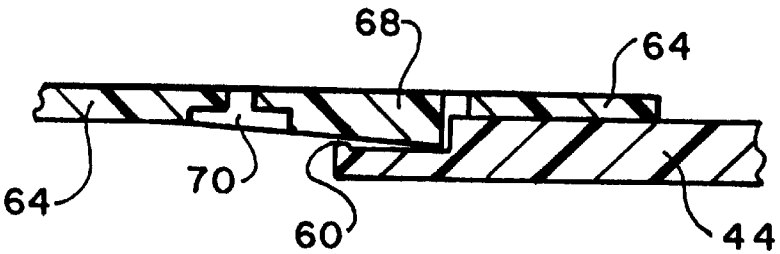
FIG. 3B is a cross section of a portion of the window locking unit illustrated in FIG. 3A taken along line IIIB—IIIB.
Figure 4A:
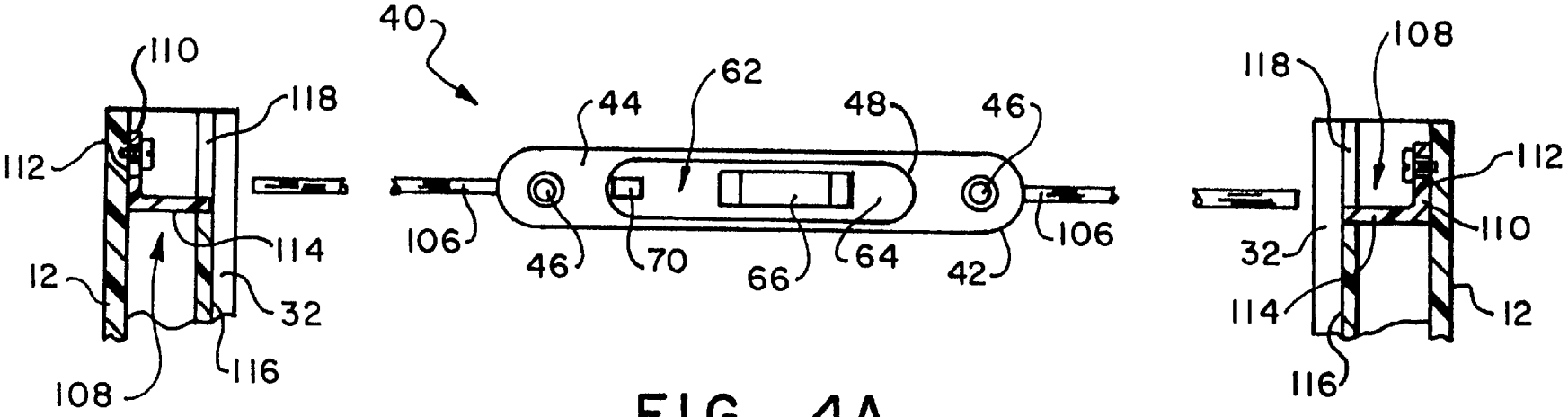
FIG. 4A is a front view of the window locking unit illustrated in FIG. 2A with the locking unit in a window tilting position.

The locking unit 40 additionally includes a pair of locking rods 106 shown in FIGS. 2A, 3A and 4A. Each locking rod 106 is attached to and extends from the main slide 62 or the second slide 82 extending over to the window jamb 12 as will be described hereinafter. Each locking rod 106 is received in one respective rod mounting hole 76 or 96 in a block member 74 or 94.

Each locking unit 40 additionally includes a right angle or L-shaped keeper member 108 adjustably attached to the side portion of the window jamb 12. Each keeper member 108 includes a mounting portion 110 with an elongated screw hole 112 therethrough. The elongated screw hole 112 allows for the adjustable mounting of the keeper member 108 on the window jamb 12. The keeper member 108 additionally includes a substantially horizontal extending locking portion 114 extending substantially perpendicular to the mounting portion 110.

The locking unit 40 can be formed of any conventional material. However, it is anticipated that the housing 42, the main slide 62, the second slide 82 and the pivot member 100 can be easily formed by injection molding using appropriate thermoplastic material. The locking rods 106 may be formed as ¼ inch aluminum rods while the keeper member 108 may be formed as stainless steel members. The window jamb 12 and sashes 20 may be formed out of conventional material as well.

Figure 2B:
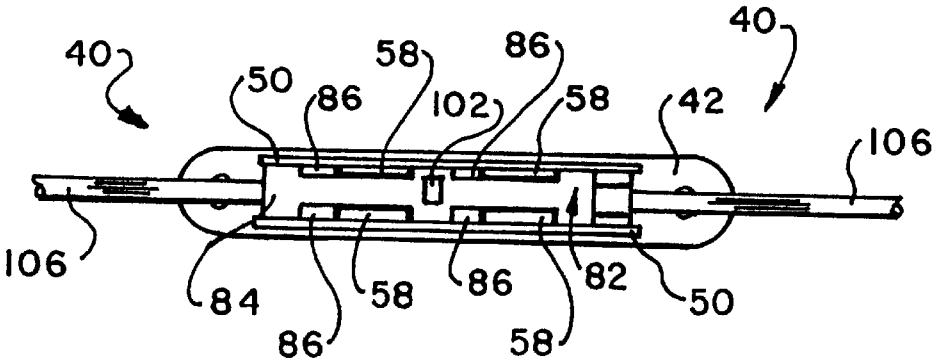
FIG. 2B is a rear view of a portion of the window locking unit illustrated in FIG. 2A.

With the locking unit 40 of the present invention, each sash 20 operates independently of the remaining sash 20. FIGS. 2A and 2B illustrate the locking unit 40 in a first locked position which will lock the sash 20 relative to the window jamb 12 preventing the sliding and also the tilting movement of the sash 20 relative to the window jamb 12. In the locked position, the main slide 62 and second slide 82 have moved the respective locking rods 106 past the window channel 32 such that the respective locking rods 106 are engaged on top of the locking portions 114 of the respective keeper members 108. The channel 32 of each window jam 12 includes a channel cap 116 which forms the back portion of the window channel 32. Near the top of the channel cap 116 is a cutout 118. The keeper member 108 is attached to the window jamb 12 in the cutout 118 of the channel cap 116 such that, in the locked position, the locking rods 106 can extend through the channel 32 and through the cutout 118 to engage with the locking portion 114 of the keeper member 108 as shown in FIG. 2A. The cutout 118 and keeper members 108 are positioned appropriately along the window jamb 12 to align with the top rail 22 of the sash 20 in the desired locked position. As shown in FIG. 2A, the engagement of the locking rod 106 with the respective locking portion 114 of the keeper member 108 will prevent downward vertical movement of the sash 20 relative to the window jamb 12. Upward vertical movement of the sash 20 is prevented by the position of the sash 20 within the window jamb 12. The tilting movement of the sash 20 about pivot member 30 is prevented by receipt of the locking rod 106 within the channel 32 as well as receipt of the locking rod 106 in cutout 118.

FIG. 2B illustrates the engagement of the projections 58 of the flanges 50 against the appropriate ends of the recesses 86 of the second slide 82 to limit the movement of the slides 82 and 62 in the locked position. FIG. 2A illustrates that only one indicating indicia 70 is invisible indicative of the locked position of the locking unit 40.

FIGS. 3A and 3B illustrate the operative position of the locking unit 40 which will allow sliding movement of the sash 20 relative to the window jamb 12 and prevents tilting movement of the sash 20 relative to the window jamb 12. In the operative position illustrated in FIG. 3A, the main slide 62 and the second slide 82 have been moved to move the respective locking rods 106 out of engagement with the respective keeper members 108. To move the locking rods 106 out of engagement with the keeper member 108, the locking rods 106 are moved to a position spaced from the keeper member 108 along the longitudinal axis of the locking rods 106 as shown in FIG. 3A. In the operative position, the locking rods 106 are maintained within the window channel 32 preventing tilting of the sash 20 about the pivot member 30. In the operative position, the sashes 20 are slidably connected to the window jamb 12 by receipt of the locking rods 106 and pivot member 30 within the window channel 32. As shown in FIG. 3A, both indicating indicia 70 are visible through the slot 48 to indicate the operative position.

The main slide 62 and, consequently, the locking unit 40 are prevented from moving from the operative position illustrated in FIG. 3A to the tilting position illustrated in FIG. 4A by engagement of the movable stop 68 in the undercut portion 60 of the housing 42 as shown in detail in FIG. 3B. The locking unit 40 is freely movable from the operative position illustrated in FIG. 3A to the locked position illustrated in FIG. 2A when the sashes 20 are in the appropriate position aligning the locking rods 106 with the cutouts 118.

FIG. 4A illustrates the tilting position of the locking units 40 which allows the tilting movement of each sash 20 about pivot member 30 relative to the window jamb 12. In the tilting position, the main slide 62 and second slide 82 have moved the locking rods 106 farther from the keeper members 108 than in the operative position. The locking rods 106 are moved to a position such that the locking rods 106 are spaced out of the window channel 32. As shown in FIG. 4A, only one of the indicating indicia 70 is visible indicative of the tilting position. Specifically, the indicating indicia, which is not located on the movable stop 68, is visible through the slot 48. To move the main slide 62 from the opposite position illustrated in FIG. 3A to the tilting position illustrated in FIG. 4A, the movable stop 68 must be pressed in to pass by the undercut portion 60. It is anticipated that the material forming the main slide 62 and movable stop 68 will have sufficient resiliency or memory to return the movable stop 68 to the position engageable with the undercut portion 60 after the main slide 62 is moved out of the tilting position.

Figure 4B:
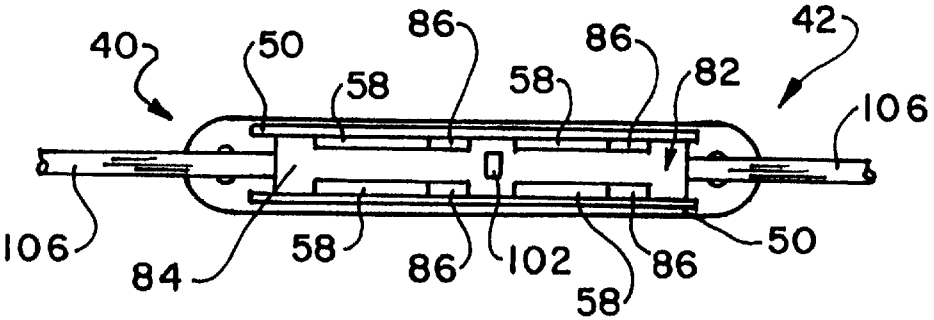
FIG. 4B is a rear view of a portion of the window locking unit illustrated in FIG. 4A.
Figure 5A:
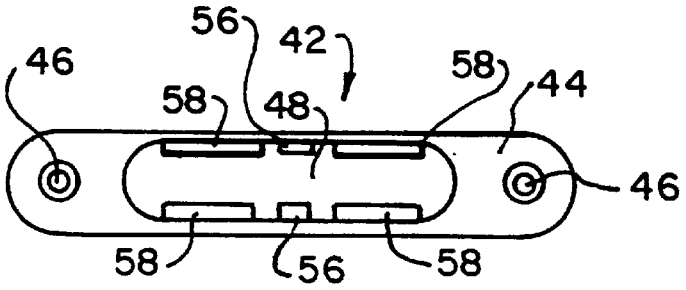
FIG. 5A is a front view of a housing of the window locking unit illustrated in FIG. 2A.
Figure 5B:
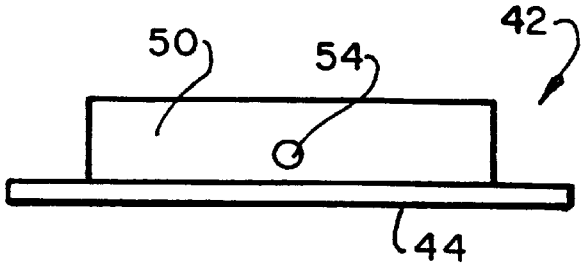
FIG. 5B is a top view of the housing illustrated in FIG. 5A.
Figure 5C:
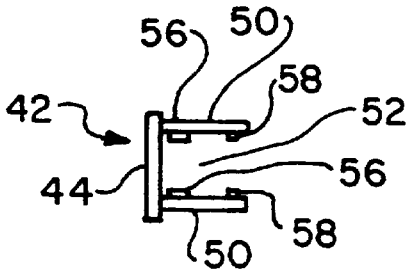
FIG. 5C is an end view of the housing illustrated in FIG. 5A.
Figure 5D:
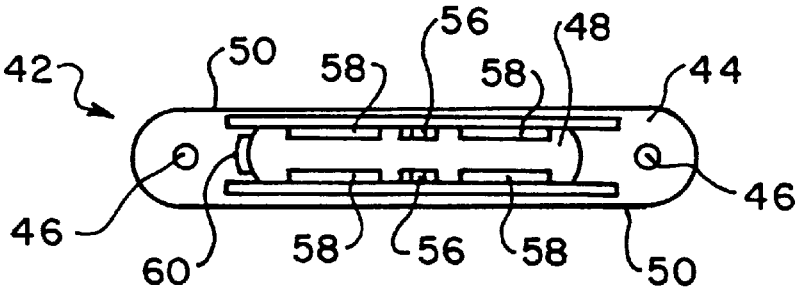
FIG. 5D is a rear view of the housing illustrated in FIG. 5A.

FIG. 4B illustrates the engagement of the projections 58 on the ends of the recesses 86 limiting movement of the second slide 82 and main slide 62 in this tilting position. It should be noted that the engagement of the projections 58 on the ends of the recesses 86 is opposite to the engagement found in the locked position illustrated in FIG. 2B. The recesses 86 and projections 58 essentially define the range of motion of the slides 62 and 82.

The present locking unit 40 and window 10 provide a significant number of advantages over the windows of the prior art. The combined locking and tilting mechanism provided by the locking unit 40 provides a clean or clear top rail 22 for the window sashes 20. The construction of the individual sashes 20 is made easier by the reduction of the hardware components to be incorporated therein. Additionally, the locking unit 40 will hide the locked/unlocked status of the window 10 from the outside providing an additional level of security.

The adjustable keeper member 108 construction of the locking unit 40 allows for adjustments to accommodate out-of-square configurations during installation. Additionally, having the locking rods 106 overlap the keeper members 108 in the locked position results in a lower alignment tolerance in the locking configuration as opposed to having the locking rods 106 extend through a specifically sized orifice in the keeper member 108. This alternative would require greater tolerances in manufacturing and in installation. The top rail 22 of both sashes 20 is now substantially identical throughout the manufacturing process as opposed to existing designs. This aspect of the window 10 of the present invention greatly enhances the manufacturing process.

The independent locking of the locking units 40 for each sash 20 allows independent movement of the sashes 20. This can provide significant safety advantages, for example, in a child's room. Specifically, the bottom sash 20 can be locked in position while the top sash 20 is opened to a certain extent to provide ventilation to the child's room. The locking of the bottom sash 20 will effectively prevent access to the open window by the child (i.e., the child will not lean or press against an unsupported outer screen). The locking of the bottom sash 20 and operation of the top sash 20 also provide ventilation with a certain amount of additional security since the bottom sash 20 is locked (i.e., better protection against intruders).

The locking unit 40 provides an improved tilting mechanism over the tilting mechanisms of the prior art. The locking unit 40 can be easily slid to the tilting position in which the user can grasp the sash 20 of the window 10 at any comfortable location to tilt the sash 20 in for cleaning and the like. It is believed that this will be a substantial benefit, particularly for wider window units. Additionally, the indicating indicia 70 on the locking unit 40 will quickly give the user a visible indication, at a distance, as to the status of the window. This should help prevent the user from inadvertently leaving the window 10 unlocked.

The locking unit 40 of the present invention is formed from a minimum number of easily manufactured parts. The locking unit 40 also provides a multi-point locking system to securely engage the window 10.

The locking unit 40 is illustrated in a double-hung window arrangement only for purposes of example. The locking unit 40 may be utilized in any construction having an application for three locking rod positions. For example, horizontally sliding sash window units could also easily incorporate the locking unit 40.

It will be apparent to those of ordinary skill in the art that various modifications may be made to the present invention without departing from the spirit and scope thereof. Consequently, the scope of the present invention is intended to be defined by the appended claims.

What is claimed is:

1. A window locking unit comprising:

a housing adapted to be attached to a sash of a window;

a main slide slidably positioned within said housing;

a locking rod attached to and extending from said main slide; and a keeper member adapted to be mounted on a jamb of the window, wherein said main slide is movable between a first position wherein said locking rod is engageable with said keeper member, a second position wherein said locking rod is spaced from said keeper member along a longitudinal axis of said locking rod, and a third position wherein said locking rod is spaced farther from said keeper member than in said second position.

2. The window locking unit of claim 1 wherein said housing includes a slot on a front face thereof, and said main slide includes a slide handle extending through said slot.

3. The window locking unit of claim 2 further including a movable stop on said main slide, said stop engageable with said housing preventing movement of said main slide to said third position when said stop is in a locked position.

4. The window locking unit of claim 3 wherein said housing slot includes an undercut portion, and wherein said stop in said locked position is engageable with said housing in said undercut such that a portion of said housing overlaps said stop.

5. The window locking unit of claim 2 further including a plurality of indicating indicia on said main slide which are selectively visible through said slot indicative of the relative position of said main slide.

6. The window locking unit of claim 2 further including a second slide slidably positioned within said housing, a second locking rod attached to and extending from said second slide, and a second keeper member adapted to be mounted on a jamb of the window, wherein said second slide is movable between a first position wherein said second locking rod is engageable with said second keeper member, a second position wherein said second locking rod is spaced from said second keeper member along a longitudinal axis of said second locking rod, and a third position wherein said second locking rod is spaced farther from said second keeper member than in said second position of said second slide.

7. The window locking unit of claim 6 further including a linkage coupling said main slide to said second slide.

8. The window locking unit of claim 7 wherein said linkage includes a pivot member pivotally attached to said housing.

9. The window locking unit of claim 6 wherein said housing includes at least one projection extending into a recess formed in said second slide, and wherein said projection is engageable with ends of said recess to limit movement of said slides.

10. The window locking unit of claim 9 wherein said housing includes a channel slidably receiving said slides, wherein each said housing projection extends into said channel.

11. The window locking unit of claim 1 wherein said keeper member is an L-shaped member with an elongated attachment slot on one portion thereof for adjustable attachment to the window jamb.

12. A window comprising:

a window jamb;

at least one sash slidably movable in said window jamb;

a pivot member pivotally connecting said sash to said window jamb, wherein said sash can tilt relative to said window jamb about said pivot member; and a single locking unit attached to said sash, said locking unit movable between a first position locking said sash relative to said window jamb preventing said sliding movement of said sash and preventing said tilting movement of said sash, a second position allowing said sliding movement of said sash and preventing said tilting movement of said sash, and a third position allowing said tilting movement of said sash.

13. The window of claim 12 wherein said locking unit includes a housing attached to said sash, said housing having a slot on a front face thereof, a main slide slidably positioned within said housing, said main slide including a slide handle extending through said slot, and a locking rod attached to and extending from said main slide.

14. The window of claim 13 further including a movable stop on said main slide, said stop engageable with said housing preventing movement of said locking unit to said third position when said stop is in a locked position.

15. The window of claim 14 wherein said housing slot includes an undercut portion, and said stop in said locked position is engageable with said housing in said undercut portion such that a portion of said housing overlaps said stop.

16. The window of claim 13 further including a plurality of indicating indicia on said main slide which is selectively visible through said slot indicative of the relative position of said main slide and said locking unit.

17. The window of claim 13 further including a second slide slidably positioned within said housing, a second locking rod attached to and extending from said second slide, and a pivot member pivotally attached to said housing, said pivot member coupling said main slide to said second slide.

18. The window of claim 13 wherein said locking unit includes a metal L-shaped keeper member adjustably attached to said window jamb.

19. A window comprising:

a window jamb;

a pair of sashes slidably movable in said window jamb;

a pivot member pivotally connecting each said sash to said window jamb, wherein said sash can be tilted relative to said window jamb around one said pivot member; and a single locking unit attached to each said sash, each said locking unit movable between a first position locking said sash relative to said window jamb preventing said sliding movement of said sash and preventing said tilting movement of said sash, a second position allowing said sliding movement of said sash and preventing said tilting movement of said sash, and a third position allowing said tilting movement of said sash, wherein each said locking unit is operable independent of the other said locking unit.

20. The window of claim 19 wherein each said locking unit includes:

a housing attached to said sash;

a main slide slidably positioned in said housing;

a locking rod attached to and extending from said main slide; and a keeper member mounted in said jamb wherein said main slide is movable between a first position wherein said locking rod is engageable with said keeper member, a second position wherein said locking rod is spaced from said keeper member along a longitudinal axis of said locking rod, and a third position wherein said locking rod is spaced farther from said keeper member than in said second position, and wherein said first, second and third positions of said main slide correspond to said first, second and third positions of said locking unit.

* * * * *